United States Patent [19]

Burns et al.

[11] 4,441,265

[45] Apr. 10, 1984

[54] ATHLETIC SHOE WITH ANKLE SUPPORT STRAP

[76] Inventors: Christopher D. Burns, 415 Chapel St., Ottawa, Ontario, Canada, K1N 7Z7; Guntis Obrascovs, 2 Sweetland Ave. Apt. 3; Andrew L. Pipe, 3-47 First Ave., both of Ottawa, Ontario, Canada

[21] Appl. No.: 365,514

[22] Filed: Apr. 5, 1982

[30] Foreign Application Priority Data

Apr. 14, 1981 [CA] Canada ..... 375455

[51] Int. Cl.[3] ..... A43B 5/04

[52] U.S. Cl. ..... 36/117

[58] Field of Search ..... 36/117, 119, 121, 50

[56] References Cited

U.S. PATENT DOCUMENTS

| | | | |
|---|---|---|---|
| 2,246,152 | 6/1941 | Wallace | 36/117 |
| 4,030,215 | 6/1977 | Vogel | 36/119 |
| 4,282,657 | 8/1981 | Antonious | 36/50 |

*Primary Examiner*—Patrick D. Lawson

*Attorney, Agent, or Firm*—Larson and Taylor

[57] ABSTRACT

An athletic shoe constructed to inhibit ankle injuries is disclosed. The shoe is in the form of a "high cut" or ankle boot with a tensioning band anchored to the outside of the boot, along the sole, rearwardly of the transverse dorsal joint. In use, the band extends over the dorsal surface of the shoe to the inside of the ankle where it is fastened under tension.

7 Claims, 3 Drawing Figures

ATHLETIC SHOE WITH ANKLE SUPPORT STRAP

FIELD OF THE INVENTION

The present invention relates to athletic shoes and particularly to athletic shoes constructed to inhibit ankle injuries.

BACKGROUND OF THE INVENTION

Amongst common athletic injuries, those to the ankle have largely been overlooked in sports safety research. This is presumably because 85% of ankle injuries are sprains that are considered to be relatively minor type of injury. A further contributing factor to this lack of interest is the fact that ankle taping has proven effective in inhibiting injuries to the ankle.

While the use of tape is effective in inhibiting ankle injuries, the tape itself is expensive and its proper application requires a knowledgeable and skilled individual. The consequence of this is that recreational athletes and most of those participating in sports below the intercollegiate and national levels rarely have any significant precautions taken to protect their ankles.

The present invention aims at the provision of an athletic shoe that incorporates means for inhibiting ankle injuries. Other proposals for this type of shoe have been made. These include the proposal of U.S. Pat. No. 3,327,410 issued June 27, 1967 to H. W. Park Sr. et al. The patent discloses an integrated ankle brace and shoe. The shoe has a stiff sole and the brace is a wide strap that is fixed to the sole beneath the arch of the foot and wraps around the foot and ankle in a figure eight configuration inside the boot. This arrangement is cumbersome and will restrict the normal biomechanical movement of the foot, such as pronation and supination of the forefoot and plantarflexion and dorsiflexion of the foot.

Another proposal is disclosed in U.S. Pat. No. 3,613,273 issued Oct. 19, 1971 to R. T. Marquis. The athletic boot disclosed in that patent has combined elastic and inelastic straps extending from the sole of the boot, up the outside of the ankle to the leg above the ankle. The strap may be located either inside or outside of the boot. The major disadvantage of this reinforcement is that it does not inhibit undue strain on the anterior talofibular ligament which is the most likely to sprain in an athletic injury. The strap reinforces the calcaneo fibular ligament that is normally subject to secondary sprain after the anterior talofibular ligament, upon further inversion of the foot.

The typical ankle injury mechanism in sports is one of plantarflexion and inversion of the foot. In the plantarflexed foot, the anterior talofibular ligament, being parallel to the long axis of the talus, is placed under tension directly proportional to the degree of plantarflexion. The calcaneofibular ligament, being almost perpendicular to the talus, is proportionally relaxed. In the neutral or dorsiflexed position, the anterior talofibular ligament fibres are under no abnormal tension whereas the calcaneofibular is under tension which will increase with greater inversion. Thus the forced inversion of the plantarflexed foot results in tension of both the anterior talofibular and calcaneo talofibular ligaments that will depend upon the degree of angular rotation acting on the foot. As a rule of thumb, it can be said that the anterior talofibular ligament is normally the first to be damaged by plantarflexion and forced inversion, followed by the calcaneofibular ligament. The present invention aims at the provision of an athletic shoe that takes this injury mechanism into consideration and provides appropriate reinforcement to inhibit injuries to the ligaments in question, without excessively restricting the normal mobility of the forefoot.

SUMMARY OF THE INVENTION

According to the present invention there is provided an athletic shoe of the ankle boot type having a substantially unstretchable band of flexible material secured to the boot to extend along the outside of the upper adjacent the sole from a position rearwardly of the calcaneofibular ligament of a wearer to a position adjacent the transverse tarsal joint, said band being configured to extend in use from the outside of the upper over the dorsal surface of the shoe to the inside of the ankle adjacent the distal tibia of a wearer, and fastener means for securing the band to the ankle of the boot.

By pulling up on the band and securing it to the ankle, the rear foot is placed in a slight valgus position which reduces the stress on the lateral ligaments in both the dorsiflexed and plantarflexed positions. The resultant pronation of the forefoot provides an even distribution of weight over the plantar aspect of the foot. While providing marked support against inversion stress, the band does not compromise the mobility of the transverse tarsal and subtalar joints, thus allowing the normal pronation and supination of the forefoot and plantarflexion and dorsiflexion of the foot to take place.

In the presently preferred embodiment of the invention, the band extends from the outside of the upper, across the sole and inside of the boot adjacent the arch, where the band is secured to the boot. This produces a "cupping" action under the foot of a wearer, so that when the band is placed in tension, it will produce a torque on the foot tending to produce an eversion. A similar effect might be achieved through appropriate design of the boot to provide the desired cupping action.

The fastener means for securing the band to the ankle of the boot is preferably a hook and looped pile fastener of the type sold under the trade mark "Velcro". This material is convenient to use and provides for virtually infinite adjustability of the band. It is also yieldable to some extent so that it will give in appropriate circumstances, permitting an ankle sprain rather than a broken bone.

It is further preferred that a second fastener of the "Velcro" type be provided between the band and the boot on the lateral instep. Once the boot has been laced on, the band is tensioned by pulling up on it, the second fastener is secured and the band is pulled under tension over the foot, around the ankle and secured in place with the first fastener.

BRIEF DESCRIPTION OF THE DRAWINGS

In drawings which illustrate exemplary embodiments of the present invention.

DETAILED DESCRIPTION

Figure 1:
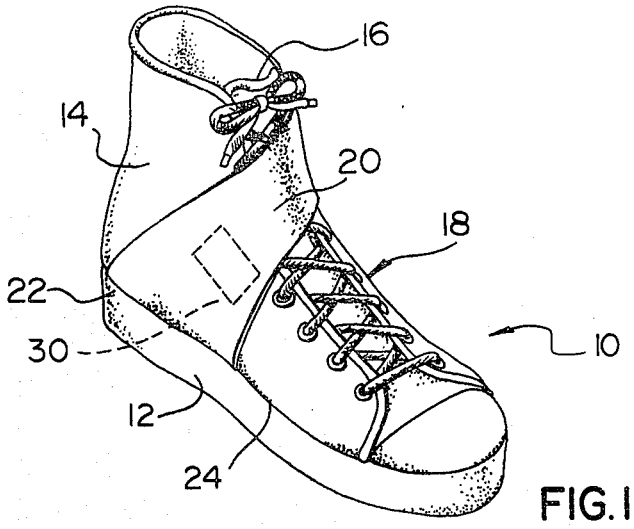
FIG. 1 is a perspective view of an athletic shoe from the front and outside.
Figure 2:
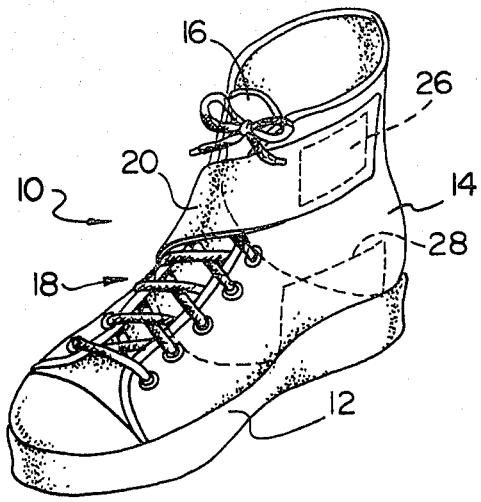
FIG. 2 is a perspective view of the shoe from the inside.

Referring to the drawings, in particular to FIGS. 1 and 2, there is illustrated an athletic shoe 10 having a sole 12 and an upper 14. The shoe is of the "high cut" or ankle boot type, where the upper 14 extends above the ankle of a wearer. The upper is provided with a conventional tongue 16 and a conventional laced closure 18.

The boot is provided with a band 20 of unstretchable, flexible material, for example a synthetic fabric material. As illustrated in FIG. 1, the band extends along the outside of the upper adjacent the sole from a position 22 to the rear of the calcaneo fibular ligament of a wearer to a position 24 at the front adjacent the transverse tarsal joint of the foot of a wearer. From the line 22–24, the band extends over the dorsal surface of the boot to the inside of the ankle adjacent the distal tibia of a wearer, as most particularly illustrated in FIG. 2. The band 20 is secured to the inside ankle of the boot by a releasable, adjustable "Velcro" fastener 26.

As illustrated in broken lines in FIG. 2, the band 20 also extends from the line 22–24 across the sole of the boot to the inside of the boot and up the inside of the boot to the end 28 above the arch of the boot. In the illustrated embodiment, the band 20 passes under the insole of the boot and up the inside of the upper to the end 28.

The illustrated embodiment further includes a second "Velcro" type fastener 30 for securing the band 20 to the boot on the lateral instep, as shown in FIG. 1.

The illustrated boot is put on in the conventional manner and tied closed with the lace closure 18. The band 20 is then pulled upwardly on the outside of the boot and the "Velcro" fastener 30 is engaged. The band 20 is then drawn under tension around the dorsal surface of the boot and the "Velcro" fastener 26 is secured. The tension in the strap 20 places the rear foot in a slight valgus position, reducing the stress on the lateral ligaments in both the dorsiflexed and plantarflexed positions. There is a resultand mild pronation of the forefoot. The band 20 acts, in effect, as a lateral deltoid ligament akin to the medial ligamentous structure which is so dense and expansive that it is very seldom injured. The band inhibits the inversion of the plantarflexed foot while resisting much of the stress that such inversion would otherwise place on the anterior talofibular and calcaneo fibular ligaments. At the same time, since the point 24 is to the rear of the transverse tarsal joint, the movements of the forefoot and the normal biomechanics of the foot as a whole are not impaired.

Figure 3:
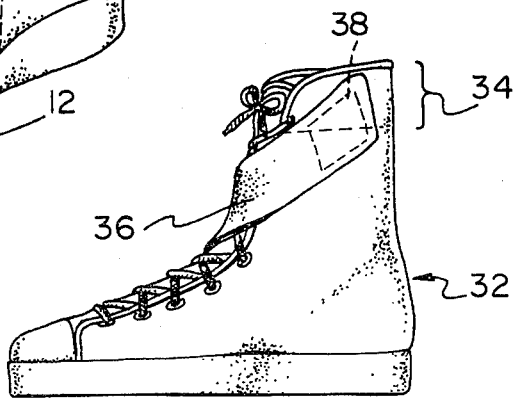
FIG. 3 is an inside elevation of another embodiment of an athletic shoe.

Another embodiment of the invention is illustrated in FIG. 3 where the illustrated boot 32 has an ankle that is higher by an amount 34 than the boot of FIGS. 1 and 2. The band 36, analogous in other respects to the band 20, extends upwardly to the rear on the inside of the ankle as secured to the ankle of the shoe in that position by a "Velcro" fastener 38. With this arrangement, the tension in the strap 36 has a larger upwards component, providing a more direct resistance to excessive stress on the lateral ligaments.

While two particular embodiments of the invention have been illustrated in the accompanying drawings and described with respect to those drawings, it is to be understood that other embodiments can be constructed. For example, the extension of the band 20 across the sole of the shoe and up the inside of the upper might be omitted, particularly if the shoe itself was constructed to provide the desired "cupping" action, gripping the foot as desired to apply a torque from the band 20. Additionally, the second fastener 30 is not necessary in all cases.

Specific reference has been made to the use of "Velcro" fasteners. It is possible to use other fasteners in place of this material, although the "Velcro" is preferred because it is particularly convenient to use and because it will yield upon the application of an excessive stress to prevent bone breakage rather than ankle sprains.

What we claim as our invention is:

1. An athletic shoe of the ankle boot type having a substantially unstretchable band of flexible material secured to the boot to extend along the outside of the upper adjacent the sole from a position rearwardly of the calcaneo fibular ligament of a wearer to a position adjacent the transverse tarsal joint, said band being configured to extend in use from the outside of the upper over the dorsal surface of the boot to the inside of the ankle adjacent the distal tibia of a wearer, and fastener means for securing the band to the ankle of the boot.

2. A shoe according to claim 1 wherein the band extends from the outside of the upper across the sole and up the inside of the boot adjacent the arch, where the band is secured to the boot.

3. A shoe according to claim 1 wherein the band extends rearwardly along the outside of the upper to a position adjacent the heel of the boot.

4. A shoe according to claim 1, 2 or 3 wherein the fastener means comprise a hook and looped pile fastener.

5. A shoe according to claim 1, 2 or 3 wherein the fastener means are positioned on the inside of the ankle of the boot.

6. A shoe according to claim 1, 2 or 3 including a second fastener means for securing the band to the boot on the lateral instep.

7. A shoe according to claim 1, 2 or 3 wherein in use the band extends upwardly to the rear on the inside of the ankle and is secured to the boot at that position by the fastener means.

* * * * *